US006702669B2

(12) United States Patent
Moody

(10) Patent No.: US 6,702,669 B2
(45) **Date of Patent: *Mar. 9, 2004**

(54) NUMERICAL TOTAL KENO GAME

(76) Inventor: Ernest W. Moody, 2116 Redbird Dr., Las Vegas, NV (US) 89134

( * ) Notice: Subject to any disclaimer, the term of this patent is extended or adjusted under 35 U.S.C. 154(b) by 0 days.

This patent is subject to a terminal disclaimer.

(21) Appl. No.: 10/166,084

(22) Filed: Jun. 11, 2002

(65) Prior Publication Data

US 2002/0198037 A1 Dec. 26, 2002

Related U.S. Application Data

(63) Continuation of application No. 09/441,412, filed on Nov. 16, 1999, now Pat. No. 6,478,677.

(51) Int. Cl.[7] ..... A63F 5/00

(52) U.S. Cl. ..... 463/18; 463/16; 463/17; 463/19

(58) Field of Search ..... 463/18; 273/139, 273/269, 274, 292, 303, 138.1, 138.2, 143 R, 142 E, 142 F

(56) References Cited

U.S. PATENT DOCUMENTS 5,106,089 A 4/1992 Wood ..... 273/139
5,651,735 A 7/1997 Baba ..... 463/18
5,909,875 A 6/1999 Weingardt ..... 273/269
5,935,001 A 8/1999 Baba ..... 463/18

OTHER PUBLICATIONS

Scarne's New Complete Guide to Gambling, John Scarne, pp. 490–499, copyright 1974.

*Primary Examiner*—Teresa Walberg
*Assistant Examiner*—Yveste G. Cherubin
(74) *Attorney, Agent, or Firm*—John Edward Roethel

(57) ABSTRACT

A game of chance is based on a keno-type game which uses one or more groups of number ranges, such as a HI group of number ranges, a LO group of number ranges and a HI/LO group of number ranges. A player makes a wager on one or more of the groups of number ranges. Each number range in a group has payout odds assigned thereto. After all wagers are made, a predetermined amount of numbers, say twenty, are randomly selected from the pool of numbers, say eighty. The numbers randomly selected are added up to determine a numerical total. The number range in which the numerical total falls is determined and the player is provided an award based on the payout odds for the number range within which the numerical total falls. The number range feature of the present invention may also be used in conjunction with a regular game of keno.

6 Claims, 2 Drawing Sheets

NUMERICAL TOTAL KENO GAME

CROSS-REFERENCE TO RELATED APPLICATION

This application is a continuation of application Ser. No. 09/441,412, filed Nov. 16, 1999, entitled "Numerical Total Keno Game", now U.S. Pat. No. 6,478,677.

This invention relates primarily to a live or electronic video keno game, and more particularly to a live or electronic video keno game in which the player wagers on what the final numerical total of the twenty selected numbers will be.

BACKGROUND OF THE INVENTION

Keno is a well known game and has been played in gaming establishments for many years. In conventional keno, there are eighty numbers in the pool of numbers that may be drawn in any one round of the game. In the typical keno game, eighty keno balls are numbered 1 through 80 and are placed in a air blower device that circulates the keno balls. Twenty of the eighty keno balls are selected each game.

Each player marks a keno ticket that is an 10×8 matrix having ten columns and eight rows. The keno numbers from one through eighty are printed on the keno ticket with each number having its own numbered spot. Prior to the start of a round of the keno game, a player selects between one and fifteen numbered spots that the player thinks will be drawn during the game. Typically a player uses a crayon-like pencil to mark the numbered spots he wishes to play on his keno ticket and the player takes his marked keno ticket to a keno station. The player makes an appropriate wager and turns in his marked keno ticket and the money at the keno station. The player receives back a stamped and receipted ticket showing the amount of the player's wager and the numbered spots that the player has selected.

The keno game operator then proceeds to draw twenty numbers from the eighty keno balls. Depending on the number of matches between the twenty numbers drawn and the numbered spots selected by the player, the player wins or loses. The more numbers that match, the higher the payoff to the player.

In a live keno game, multiple players participate each game and no players may win, some players may win or all players may win. In traditional live keno, players may select between one and fifteen numbers and wagers can range from as little as 35¢ a game to $5, $10 or even higher dollars per game. Typically each establishment operating a keno game will provide a group of payout charts showing the amount that it is possible for the player to win based on the amount wagered, the number of numbered spots selected by the player and the number of matches achieved by the player when the twenty keno balls are selected. For example, if the player wagers $1 and selects one number, the player will typically win $3 if his selected numbered spot is one of the twenty numbered keno balls drawn during the play of the game. Similarly, if the player selects fifteen numbers, the player will typically be paid if anywhere between a total of eight and fifteen of his numbered spots match the twenty numbered keno balls drawn. The highest payout will be made for matching fifteen out of fifteen, with lower payouts made for matching fourteen out of fifteen, thirteen out of fifteen and so on down to eight out of fifteen. Any matches of seven or less are typically losing plays. Similar payout schemes are provided when the player marks between one and fifteen numbered spots during any round of a keno game.

When the player plays an electronic video keno gaming machine, a single player plays against the keno gaming machine for each round of the game and the player either wins or loses each round. The player wagers a coin, token or credit and selects the quantity of numbered spots that the player is attempting to match during that round of the game. All eighty numbers are displayed on a video screen with a 10×8 matrix similar to that of a keno ticket. The numbers are selected by the player using by a light pen, or by pressing the numbers on a selection panel or by touching the numbers selected using conventional touch screen technology.

In the typical electronic keno format, the player may select between one and ten numbered spots to attempt to match. After the player has completed selecting the numbered spots that the player wishes to match and has made the appropriate wager, the player presses the "Start" button. This causes the electronic controls of the gaming machine to randomly select twenty numbers from the pool of eighty numbers and the selected numbers are displayed to the player. The electronic controls of the gaming machine determine whether the player has achieved a winning payout at the conclusion of each round of the game. Just as in live keno, the player wins when he matches all or a predetermined minimum number of his selected numbered spots. If the player matches less than the predetermined minimum number of his selected numbered spots, then the player loses his wager. Payouts are made by accruing credits on the credit meter of the gaming machine or dispensing coins or tokens into a payout tray.

The basic principles of the play of keno are set out in Scarne's New Complete Guide to Gambling, by John Scarne, at pages 490–499.

Variations of keno have been presented on electronic gaming machines used in casinos. In a game known as "Top/Bottom Keno", the player wagers on either the keno numbers 1–40, which are in the top number section on a keno display, or the numbers 41–80, which are in the bottom number section on a keno display. The traditional twenty keno numbers are drawn electronically and the selected numbers are highlighted on the keno display. At the conclusion of drawing the numbers, the amount of numbers drawn that are in the top section and in the bottom section are displayed. The player wins or loses based on how many numbers are in the section (either the top section or the bottom) that the player chose at the start of the game. For example, if all twenty numbers chosen are in the top section (and therefore there are no numbers chosen in the bottom section), the player wins a large payout such as 5000-for-1 odds on the amount of the players wager. If there are ten numbers in the top section and ten numbers in the bottom section, the player loses. A pay table is displayed to the player showing the various odds payouts depending on how many numbers are selected in the top section and the bottom section, respectively.

U.S. Pat. No. 5,108,089 (Wood) discloses a lottery summing game in which the numerical total of the numbers drawn in the lottery is summed and the player wagers on what the numerical total will be. The player is provided with a wagering slip upon which the player marks which numerical totals the player thinks the selected lottery numbers will total. The wagering slip shows various winning number groups from which the player may select one, some or all of the wagering number groups with each wagering number group requiring a separate wager. Each wagering number group has its associated payout odds. As disclosed in this patent, the pool of lottery numbers range from 0 to 9 and there are three groups of lottery numbers, with one number being drawn from each group. The three lottery numbers are drawn and the numerical value of the drawn lottery numbers is totaled. This final sum total is then compared to the player slips and any player who has selected the correct final sum total is a winner. A winning player is awarded odds based on the amount of his wager depending on what the final sum total is. The odds range from 250-for-1 down to 1.75-for-1. Other betting possibilities are disclosed, such as wagering that all three numbers are odd; all three numbers are even; two numbers are odd and one number is even; or two numbers are even and one number is odd.

The drawback of this method of play in the Wood '089 patent is that the player is limited to a very narrow range of possible winning combinations and the pool of numbers from which the numbers are drawn is quite small.

It is an object of the present invention to provide an improved keno game that offers the player the opportunity to win large payouts depending on what the final numerical total of the selected keno numbers is when all of the selected keno numbers are added up.

It is a feature of the present invention to provide a plurality of ranges of numerical totals that may be achieved when the twenty selected keno numbers are added up. The player selects either a high range or a low range or both a high/low range of numerical totals. Depending on the final numerical total of the twenty selected keno numbers, the player either wins or loses on his wager. If the player has made a winning wager, the player receives odds payouts based on the amount of the player's wager depending on which range of numerical totals the final numerical total falls within.

It is an advantage of the present invention that a game of keno will be enhanced by this new and exciting wager and that the player can win a large odds payout based on the amount of his numerical total wager.

Other objects, features and advantages of the present invention will become apparent from a consideration of the following detailed description.

SUMMARY OF THE INVENTION

A game of chance is based on a keno-type game which uses one or more groups of number ranges. A player makes a wager on one or more of the groups of number ranges. Each number range in a group has payout odds assigned thereto. After all wagers are made, a predetermined amount of numbers, say twenty, are randomly selected from the pool of numbers, say eighty. The numbers randomly selected are added up to determine a numerical total. The number range in which the numerical total falls is determined and the player is provided an award based on the payout odds for the number range within which the numerical total falls.

DETAILED DESCRIPTION OF THE PREFERRED EMBODIMENTS

The method of the present invention is played using either a live keno game format or using an electronic keno gaming machine. The description that follows refers to an electronic keno gaming machine, but the same principles of the present invention can be easily adapted to a live keno game format.

Figure 1:
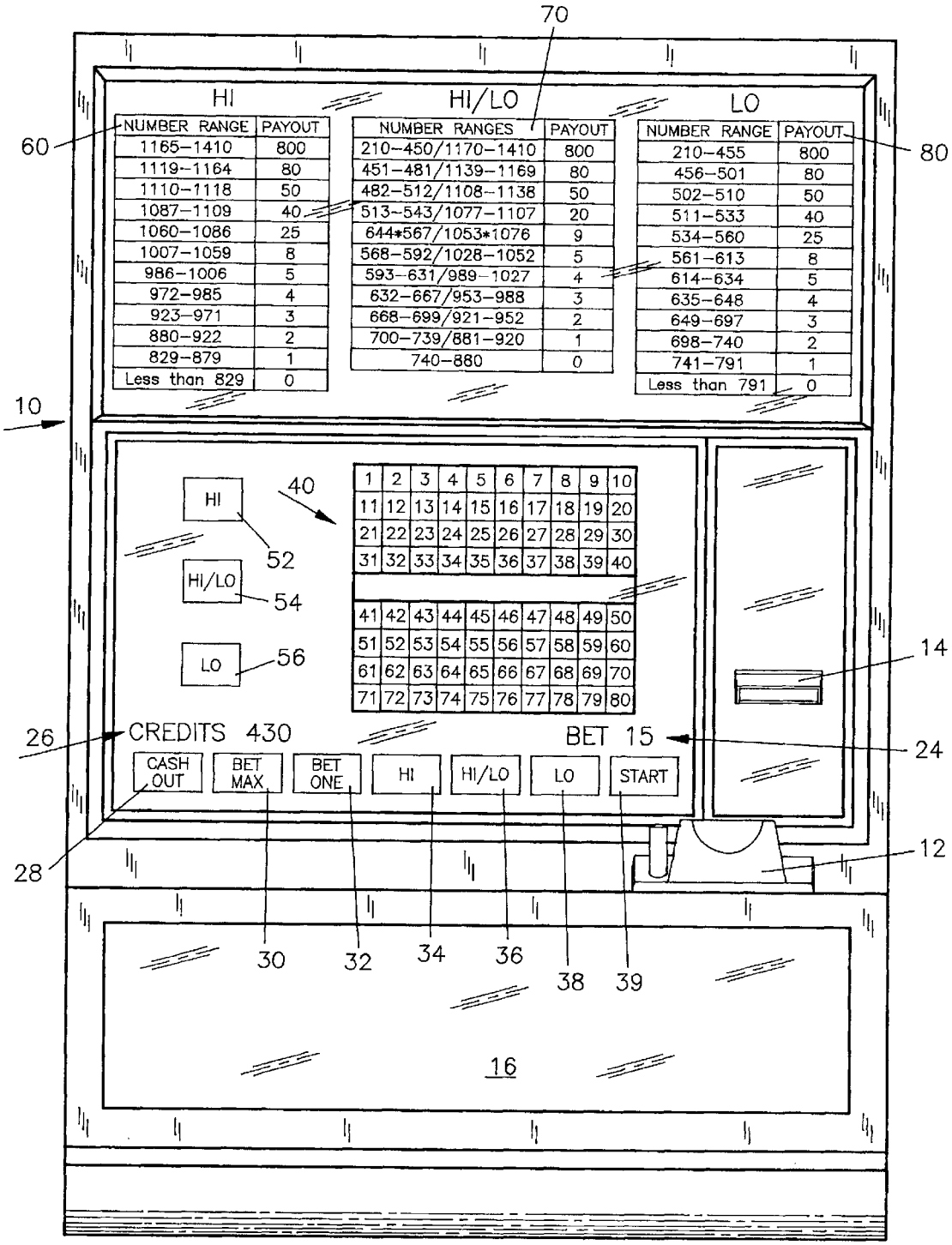
FIG. 1 shows a representative keno ticket display that can be used in the method of the present invention.

An electronic keno gaming machine is shown at 10 in FIG. 1 and is provided with a video screen display 22, a coin head 12 for receiving coins or gaming tokens, a bill acceptor 14 for receiving paper currency, a coin hopper (not shown, but mounted on the interior of the gaming machine 10) for making payouts into a payout tray 16, a plurality of payout tables 60, 70 and 80 which can be displayed on the gaming glass or alternatively on the video screen display 22 and computer controls (also not shown and mounted on the interior of the gaming machine) to operate the gaming machine. Instead of using a payout hopper to dispense coins or gaming tokens when the player cashes out, a ticket printer or another suitable payout device such as a coupon device or the like.

Also provided on the video screen display 22 are various touch screen locations that allow the player to make wagers, start the play of the game and collect winnings. The touch screen locations include a CASH OUT location 28, a BET MAX location 30, a BET ONE location 32 and a START location 39. Instead of using touch screen locations for the operations of the gaming machine, buttons may be provided on a button panel to allow the player to wager, start the play of the game and cash out any accumulated credits. Also provided on the video screen display 22 are locations that show the amount of the BET 24 made by the player for that round of the game and the CREDITS 26 that have been accumulated by the player during play of the game or from introducing currency into the bill acceptor 14.

Additionally in connection with the method of the present invention, the video screen display 22 is provided with locations to allow the player to wager on the HI game 34, the HI/LO game 36 and/or the LO game 38 as will be further explained below. Also, instead of using touch screen locations to allow the player to select which of the possible games the player wishes to play, buttons may be provided on a button panel.

Also included on the video screen display 22 is a 10×8 matrix of the eighty numbers which represents the keno ticket display 40 used in the method of play of the present invention. As the keno numbers are randomly selected during the player of the game, the selected numbers are highlighted on the matrix 40 to show the results of the play.

In the method of play using the keno ticket display 40 shown in FIG. 1, the player makes one, two or three wagers. For example, the player may wager on the "HI" group of ranges of numbers, the player may wager on the "LO" group of ranges of numbers and/or the player may wager on the "HI/LO" group of ranges of numbers.

Figure 2:
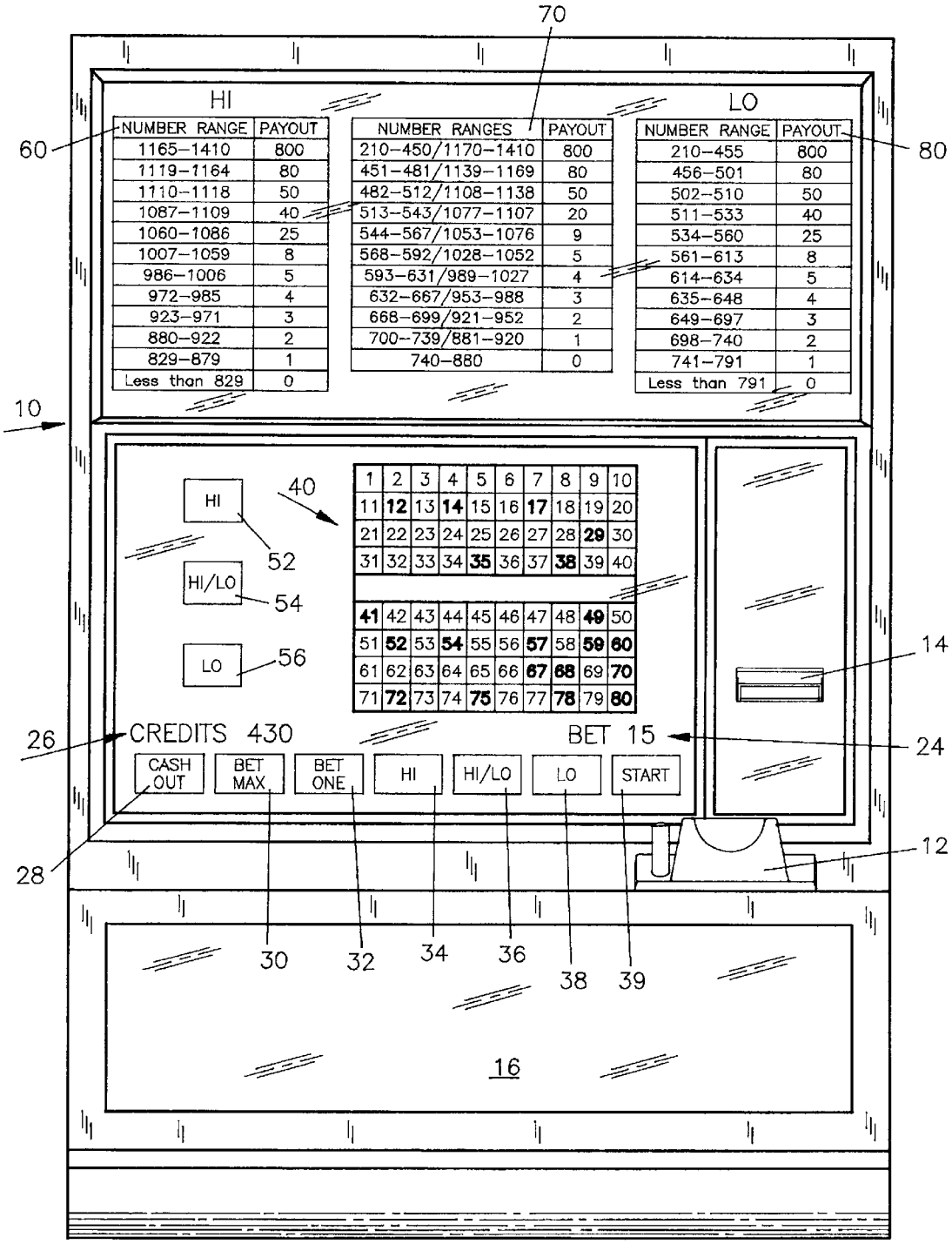
FIG. 2 shows a representative keno ticket display after the numbers have been randomly selected in accordance with the method of the present invention.

After the player made his wager or wagers, the player presses the "START" location 39 on the electronic keno gaming machine to activate the play of the game. The computer controls randomly select twenty numbers from the complete pool of eighty numbers and these twenty numbers are displayed on the keno ticket. For example as shown in FIG. 2, the twenty numbers can be 12, 14, 17, 29, 35, 38, 41, 49, 52, 54, 57, 59, 60, 67, 68, 70, 72, 75, 78 and 80. The numbers selected can be indicated in any suitable manner such as the using the bold marking shown in FIG. 2 or by highlighting the selected numbers.

The numbered spots selected by the computer are then added up and the sum of these twenty numbers are shown in a suitable location on the video display screen. The possible sums of twenty selected keno numbers range from a low of 210 to a high of 1410. With reference to the numbers selected and shown in FIG. 2, the sum of these twenty numbers would be 1027.

Each pay table is provided with a group of number ranges and corresponding payouts if the total sum of the twenty drawn keno numbers falls within a particular range. In the preferred embodiment of the present invention, three distinct pay tables are provided to the player: a "HI" pay table 60, a "LO" pay table 70 and a "HI/LO" pay table 80.

Table 1 is representative of a suitable "HI" pay table that may be used in the present invention. The higher the total sum of the drawn numbers, the higher the payout to the player.

TABLE 1

| NUMBER RANGE | PAYOUT |
|---|---|
| 1165–1410 | 800 |
| 1119–1164 | 80 |
| 1110–1118 | 50 |
| 1087–1109 | 40 |
| 1060–1086 | 25 |
| 1007–1059 | 8 |
| 986–1006 | 5 |
| 972–985 | 4 |
| 923–971 | 3 |
| 880–922 | 2 |
| 829–879 | 1 |
| Less than 829 | 0 |

With reference to the example shown in FIG. 2, if the player had wagered on the "HI" range pay table 60, the player would have won 8 credits for each credit wagered since the total sum of the twenty drawn keno numbers was 1027.

Table 2 is representative of a suitable "LO" pay table that may be used in the present invention. The lower the total sum of the drawn numbers, the lower the payout to the player.

TABLE 2

| NUMBER RANGE | PAYOUT |
|---|---|
| 210–455 | 800 |
| 456–501 | 80 |
| 502–510 | 50 |
| 511–533 | 40 |
| 534–560 | 25 |
| 561–613 | 8 |
| 614–634 | 5 |
| 635–648 | 4 |
| 649–697 | 3 |
| 698–740 | 2 |
| 741–791 | 1 |
| More than 791 | 0 |

With reference to the example shown in FIG. 2, if the player had wagered on the "LO" range pay table 70, the player would have lost his wager since the total sum of the twenty drawn keno numbers was 1027.

Table 3 is representative of a suitable "HI/LO" pay table that may be used in the present invention. The higher or lower the total sum of the drawn numbers, the higher the payout to the player.

TABLE 3

| NUMBER RANGES | PAYOUT |
|---|---|
| 210–450/1170–1410 | 800 |
| 451–481/1139–1169 | 80 |

TABLE 3-continued

| NUMBER RANGES | PAYOUT |
|---|---|
| 482–512/1108–1138 | 50 |
| 513–543/1077–1107 | 20 |
| 544–567/1053–1076 | 9 |
| 568–592/1028–1052 | 5 |
| 593–631/989–1027 | 4 |
| 632–667/953–988 | 3 |
| 668–699/921–952 | 2 |
| 700–739/881–920 | 1 |
| 740–880 | 0 |

With reference to the example shown in FIG. 2, if the player had wagered on the "HI/LO" range pay table 80, the player would have won 4 credits for each credit wagered since the total sum of the twenty drawn keno numbers was 1027.

The payouts shown in each pay table are for each coin, token or credit wagered and would be multiplied by the number of coins, tokens or credits wagered by the player. Most electronic keno gaming machines allow the player to wager from one to four coins, tokens or credits of whatever the denomination being used on the keno gaming machine.

Any suitable payout table can be used based on the mathematical odds which the gaming establishment wishes to offer to the player.

The method of the present invention can also be applied to a live keno game format. Players would select whether they wanted to wager on a "HI" group of number ranges, a "LO" group of number ranges and/or a "HI/LO" group of number ranges. Pay tables would be provided for each group of number ranges and after all players have made their wagers, twenty keno numbers would be selected in any suitable manner such as using a conventional keno ball air blower apparatus. The total sum of the twenty drawn numbers would be determined and winning wagers would be paid according to the pay table and the amount wagered by the player. The method of the present invention could be run in conjunction with a conventional live keno game and adds another group of wagers that can be available to keno players.

The method of the present invention may also be played in conjunction with a regular game of keno. The player would make a suitable wager on the regular keno game and would also make on or more wagers on a group or groups of number ranges as discussed above. After the keno balls are drawn, the player would be paid for any winning hits achieved by the player during the regular keno game and the player would also be paid for any winning wagers made by the player based on the numerical total of the drawn keno balls. The regular keno game could be provided with any suitable pay table based on the percentage return which the gaming establishment wishes to offer to its players.

It is theoretically possible to use the number range feature of the present invention, when coupled with a mandatory wager on the regular keno game, to raise the percentage return of the keno game and thus increase the player appeal of keno. Typical keno percentages in widespread use having a percentage return between 85% and 92%. Keno is not as popular as it once was because other games of chance, such as video poker, offer the player a higher percentage return, on the order of 97%–99%. By adjusting the payout amounts and by selecting appropriate number ranges for each payout amount, the number range feature of the present invention can be used to raise the overall return of regular keno to a percentage that is competitive with video poker. By making keno competitive with the other games of chance offered in the gaming establishment, the popularity of keno could be increased, especially among those players who are reluctant to play video poker because the are not comfortable with learning the strategy involved in determining which cards to hold and which cards to discard when they are playing video poker.

The method of the present invention has been described in the context of the conventional keno format which uses a complete pool of eighty numbers, from which twenty numbers are drawn each game. However, the present invention can also be applied to a keno-type game in which the size of the complete pool can be more or less than eighty numbers and which the amount of numbers drawn can be more or less than twenty numbers. If the size of the complete pool is changed or the amount of numbers drawn is changed, then the groups of number ranges and the payouts will also be changed to reflect the varying mathematical odds which are based on the size of the complete pool and the amount of numbers drawn.

The method of the present invention can also be applied to traditional lottery games run by governmental agencies or other lottery game operators. Lottery games typically use a smaller number pool than the eighty numbers used in keno and suitable groups of number ranges for the HI group, the LO group and the HI/LO group would be selected to adapt the method of the present invention to a lottery game. Any suitable percentages can be applied to the lottery variation of the present invention with the percentages being attained by the selection of the winning and losing groups of number ranges and the payouts made to the player for each winning group of number ranges.

While the invention has been illustrated with respect to several specific embodiments thereof, these embodiments should be considered as illustrative rather than limiting. Various modifications and additions may be made and will be apparent to those skilled in the art. Accordingly, the invention should not be limited by the foregoing description, but rather should be defined only by the following claims.

What is claimed is:

1. A method of playing a keno game comprising:

a) providing a keno pay table based on the number of hits achieved by a player compared to the quantity of numbered spots selected by the player;

b) providing a plurality of groups of number ranges and assigning payout odds to each of the number ranges within the group;

c) a player making a first wager to play a regular keno game and a player making at least a second wager to play a number range feature of the keno game;

d) randomly selecting a predetermined amount of numbers from a pool of numbers;

e) determining the number of hits achieved by the player compared to the quantity of numbered spots selected by the player;

f) paying the player a first award based on the number of hits achieved by the player and based on the amount of the first wager made by the player;

g) adding up the numerical values of the selected numbers to determine a numerical total;

h) determining the number range in which the numerical total falls; and i) paying a second award based on the payout odds for the number range within which the numerical total falls based on the amount of the second wager made by the player wherein the award paid to the player is based on the following pay table:

| NUMBER RANGE | PAYOUT |
|---|---|
| 1165–1410 | 800 |
| 1119–1164 | 80 |
| 1110–1118 | 50 |
| 1087–1109 | 40 |
| 1060–1086 | 25 |
| 1007–1059 | 8 |
| 986–1006 | 5 |
| 972–985 | 4 |
| 923–971 | 3 |
| 880–922 | 2 |
| 829–879 | 1 |
| Less than 829 | 0. |

2. The method of claim 1 in which the predetermined amount of numbers selected is twenty and the amount of numbers in the pool of numbers is eighty.

3. A method of playing a keno game comprising:

a) providing a keno pay table based on the number of hits achieved by a player compared to the quantity of numbered spots selected by the player;

b) providing a plurality of groups of number ranges and assigning payout odds to each of the number ranges within the group;

c) a player making a first wager to play a regular keno game and a player making at least a second wager to play a number range feature of the keno game;

d) randomly selecting a predetermined amount of numbers from a pool of numbers;

e) determining the number of hits achieved by the player compared to the quantity of numbered spots selected by the player;

f) paying the player a first award based on the number of hits achieved by the player and based on the amount of the first wager made by the player;

g) adding up the numerical values of the selected numbers to determine a numerical total;

h) determining the number range in which the numerical total falls; and i) paying a second award based on the payout odds for the number range within which the numerical total falls based on the amount of the second wager made by the player wherein the award paid to the player is based on the following pay table:

| NUMBER RANGE | PAYOUT |
|---|---|
| 210–455 | 800 |
| 456–501 | 80 |
| 502–510 | 50 |
| 511–533 | 40 |
| 534–560 | 25 |
| 561–613 | 8 |
| 614–634 | 5 |
| 635–648 | 4 |
| 649–697 | 3 |
| 698–740 | 2 |
| 741–791 | 1 |
| More than 791 | 0. |

4. The method of claim 3 in which the predetermined amount of numbers selected is twenty and the amount of numbers in the pool of numbers is eighty.

5. A method of playing a keno game comprising:

a) providing a keno pay table based on the number of hits achieved by a player compared to the quantity of numbered spots selected by the player;

b) providing a plurality of groups of number ranges and assigning payout odds to each of the number ranges within the group;

c) a player making a first wager to play a regular keno game and a player making at least a second wager to play a number range feature of the keno game;

d) randomly selecting a predetermined amount of numbers from a pool of numbers;

e) determining the number of hits achieved by the player compared to the quantity of numbered spots selected by the player;

f) paying the player a first award based on the number of hits achieved by the player and based on the amount of the first wager made by the player;

g) adding up the numerical values of the selected numbers to determine a numerical total;

h) determining the number range in which the numerical total falls; and i) paying a second award based on the payout odds for the number range within which the numerical total falls based on the amount of the second wager made by the player wherein the award paid to the player is based on the following pay table:

| NUMBER RANGES | PAYOUT |
|---|---|
| 210–450/1170–1410 | 800 |
| 451–481/1139–1169 | 80 |
| 482–512/1108–1138 | 50 |
| 513–543/1077–1107 | 20 |
| 544–567/1053–1076 | 9 |
| 568–592/1028–1052 | 5 |
| 593–631/989–1027 | 4 |
| 632–667/953–988 | 3 |
| 668–699/921–952 | 2 |
| 700–739/881–920 | 1 |
| 740–880 | 0. |

6. The method of claim 5 in which the predetermined amount of numbers selected is twenty and the amount of numbers in the pool of numbers is eighty.

* * * * *